US006698252B1

(12) United States Patent
Norris et al.

(10) Patent No.: US 6,698,252 B1
(45) Date of Patent: Mar. 2, 2004

(54) SNAG-RESISTANT MATTE-EFFECT WARP-KNITTED TEXTILE FABRIC FOR ACTIVEWEAR APPAREL

(75) Inventors: Stephanie Booz Norris, Greensboro, NC (US); Paul James Manzi, Greensboro, NC (US)

(73) Assignee: Guilford Mills, Inc., Greensboro, NC (US)

( * ) Notice: Subject to any disclaimer, the term of this patent is extended or adjusted under 35 U.S.C. 154(b) by 155 days.

(21) Appl. No.: 09/922,828

(22) Filed: Aug. 6, 2001

(51) Int. Cl.[7] ..... D04B 21/00
(52) U.S. Cl. ..... 66/195
(58) Field of Search ..... 66/169 R, 170, 66/171, 192, 193, 195; 442/304, 306, 308, 312

(56) References Cited

U.S. PATENT DOCUMENTS

| | | | | | |
|---|---|---|---|---|---|
| 3,390,549 | A | | 7/1968 | Brand | 66/86 |
| 3,442,099 | A | | 5/1969 | Auville et al. | 66/86 |
| 3,474,644 | A | | 10/1969 | Frank | 66/86 |
| 3,931,721 | A | | 1/1976 | Adamson | 66/195 |
| 4,658,604 | A | | 4/1987 | Wilson | 66/192 |
| 4,881,383 | A | | 11/1989 | Spillane et al. | 66/194 |
| 5,359,732 | A | * | 11/1994 | Waldman et al. | 2/67 |
| 5,542,269 | A | | 8/1996 | Richards | 66/195 |
| 5,657,648 | A | * | 8/1997 | Ives et al. | 66/193 |
| 5,765,401 | A | * | 6/1998 | Ives et al. | 66/203 |
| 5,832,749 | A | | 11/1998 | Antonietti | 66/203 |
| 5,855,124 | A | * | 1/1999 | Donaghy et al. | 66/195 |
| 5,899,095 | A | | 5/1999 | Spillane | 66/207 |
| 6,105,400 | A | | 8/2000 | Yoon | 66/194 |

* cited by examiner

*Primary Examiner*—Danny Worrell
(74) *Attorney, Agent, or Firm*—Kennedy Covington Lobdell & Hickman, LLP

(57) ABSTRACT

A warp-knitted textile fabric adapted for use in activewear apparel and characterized by a matte surface effect, resistance to snagging, and relatively uniform stretchability in widthwise and lengthwise directions, the fabric having a three-bar warp knitted structure comprised of first and second sets of body yarns and a third set of elastic yarns interknitted in a Raschel-type stitch pattern wherein one of the sets of body yarns is knitted in a double needle overlap pattern.

7 Claims, 2 Drawing Sheets

SNAG-RESISTANT MATTE-EFFECT WARP-KNITTED TEXTILE FABRIC FOR ACTIVEWEAR APPAREL

BACKGROUND OF THE INVENTION

The present invention relates generally to textile fabrics and, more particularly, to warp-knitted textile fabrics adapted for use in swimwear, other sportswear and like activewear apparel.

It is often desirable for many types of sportswear and like activewear apparel to have a sufficient degree of stretchability to conform to the wearer's body yet also to permit the wearer a freedom of movement attendant to the activities for which the garments are intended. This combination of characteristics is perhaps most typical of swimwear, especially women's swimwear. Likewise, apart from these functional characteristics, it is equally desirable for such apparel items to have good wear resistant qualities, e.g., to resist snagging and picking, and to present a pleasing appearance, particularly as to its surface effect. Unfortunately, conventional fabrics seldom provide an optimal combination of these characteristics.

With reference to FIG. 1 of the accompanying drawings, an example of a popular form of conventional swimwear fabric is depicted in a common form of point diagram representing the stitch patterns of the respective yarns in the fabric. As will be recognized by those persons skilled in the art, this fabric is a conventional form of Raschel-type warp-knitted fabric of a three-bar construction formed of one warp set of elastic yarns and two warps of inelastic body yarns, e.g., polyester yarns, in a repeating pattern wherein the elastic warp yarns are knitted on Bar I of the warp knitting machine in a 2-2, 4-4, 2-2, 0-0 stitch pattern, one warp set of the polyester yarns are knitted on Bar II of the warp knitting machine in a 2-2, 2-4, 2-2, 2-0 stitch pattern, and the other warp set of the polyester yarns are knitted on Bar III of the warp knitting machine in a 4-6, 4-4, 2-0, 2-2 stitch pattern.

While the conventional fabric of FIG. 1 has achieved a degree of acceptance and success in use as a swimwear fabric, it suffers from several disadvantages which limit its acceptability. First, the fabric is susceptible to being snagged or picked in use, i.e., the surface yarns are sufficiently exposed to becoming caught on objects so as to subject the constituent filaments in the yarns to being pulled from the knitted structure and even severed. Secondly, the stitch construction of the fabric as described above gives the fabric an imbalance in lengthwise stretchability in relation to widthwise stretchability, which can affect the fit and wear properties of apparel items made from the fabric. Finally, the fabric presents a rather shiny surface appearance, which may be desirable in some apparel applications, but may be equally undesirable for use in other apparel items.

SUMMARY OF THE INVENTION

It is accordingly an object of the present intention to provide an improved warp-knitted fabric which overcomes the disadvantages of the conventional fabric of FIG. 1. A more particular object of the present invention is to provide such a fabric with a matte surface effect, resistance to snagging, and a relatively uniform stretchability in both widthwise and lengthwise directions.

Briefly summarized, the present invention provides a warp-knitted textile fabric of a three-bar knitted structure basically comprised of three sets of warp yarns interknitted in a Raschel-type stitch pattern wherein one of the sets of warp yarns is knitted in a double needle overlap pattern. Preferably, the three sets of warp yarns comprise two sets of body yarns and a third set of elastic yarns, with one of the sets of body yarns being knitted in the double needle overlap pattern, the other set of body yarns being knitted in a plain stitch pattern, and the elastic yarns being knitted in an inlay pattern. More specifically, the one set of body yarns is preferably knitted in a repeating 1-3, 2-2, 2-0, 1-1 double needle overlap pattern, the other set of body yarns is knitted in a repeating 1-1, 1-2, 1-1, 1-0 stitch pattern, and the set of the elastic yarns is knitted in a 1-1, 2-2, 1-1, 0-0 inlay pattern. Advantageously, the warp-knitted fabric of the present invention having this construction is accordingly adapted for use in activewear apparel and particularly is characterized by a matte surface effect, resistance to snagging, and relatively uniform stretchability in widthwise and lengthwise directions.

Other aspects, features and advantages of the present invention will be understood and will become apparent to those persons skilled in the art from the description hereinbelow of a preferred embodiment with reference to the accompanying drawings.

DESCRIPTION OF THE PREFERRED EMBODIMENT

Figure 1:
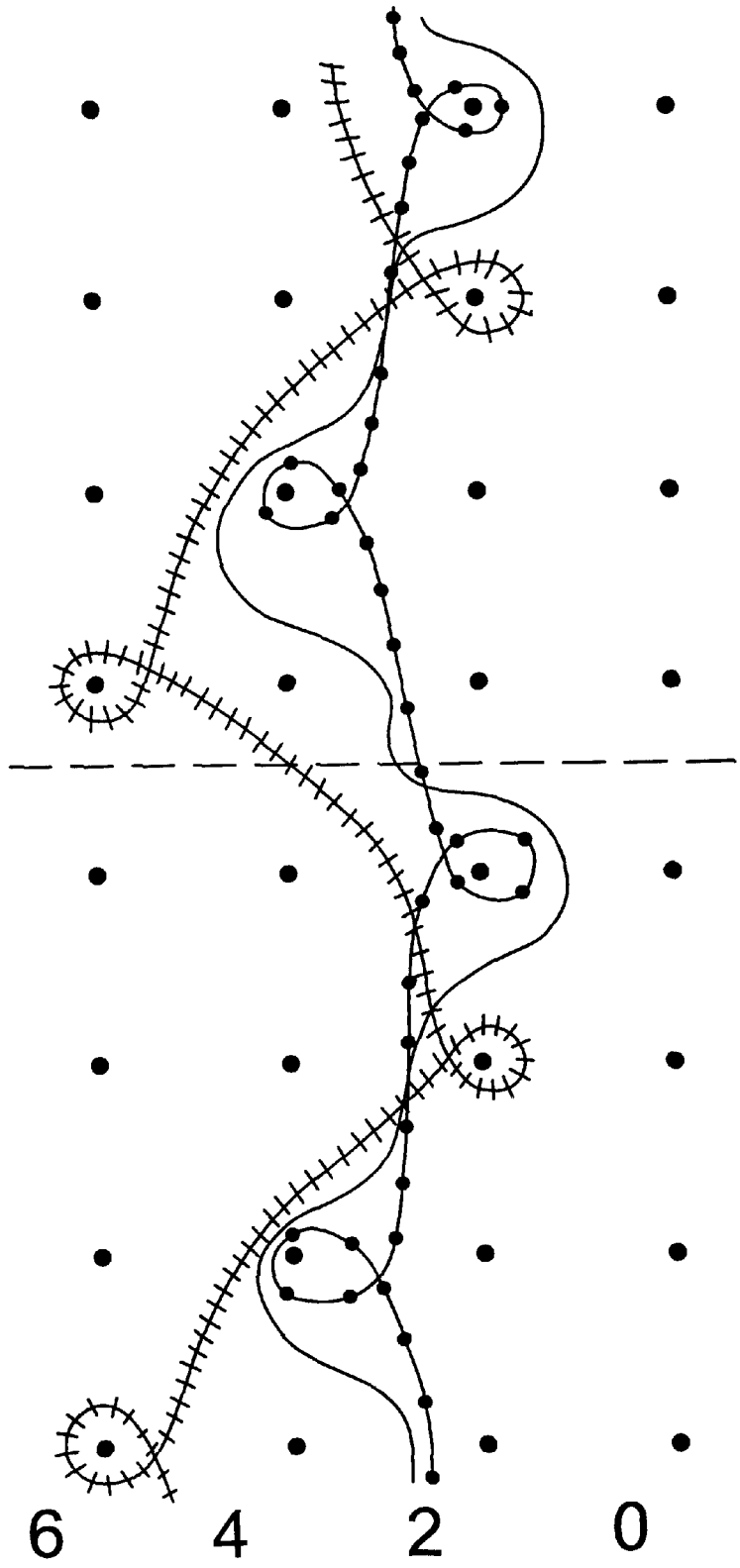
Fig. 1 Prior Art
FIG. 1 is a point diagram showing the stitch patterns for, and the interconnecting relationship between, the body and elastic yarns carried out by a warp knitting machine in knitting a conventional form of warp-knitted fabric as already described more fully above.

As explained more fully herein, the fabric of the present invention is formed on a warp knitting machine which may be of any conventional type of an at least three-bar construction having three or more yarn guide bars and a needle bar, e.g., a conventional tricot or Raschel warp knitting machine. The construction and operation of such machines are well-known in the knitting art and need not herein be specifically described and illustrated. In the following description, the yarn guide bars of the knitting machine are identified as "top", "middle", and "bottom" guide bars for reference purposes only and not by way of limitation. As those persons skilled in the art will understand, such terms equally identify knitting machines whose guide bars may be referred to as "front", "middle" and "back" guide bars, which machines of course are not to be excluded from the scope and substance of the present invention. As further used herein, the "bar construction" of a warp knitting machine refers to the number of yarn guide bars of the machine, while the "bar construction" of a warp knitted fabric refers to the number of different sets of warp yarns included in the fabric, all as is conventional terminology in the art.

As is conventional, the needle bar of the warp knitting machine carries a series of aligned knitting needles, while each guide bar of the machine carries a series of guide eyes, the needle and guide bars of the machine preferably having the same gauge, i.e., the same number of needles and guide eyes per inch. According to the embodiment of the present fabric illustrated in FIG. 2, the bottom (or back) guide bar I is threaded on every guide eye with a set of elastic yarns 10 delivered from a respective warp beam (not shown), the middle yarn guide bar II of the machine is likewise threaded on every guide eye with a set of inelastic body yarns 12 delivered from another warp beam (also not shown), and the top (or front) guide bar III is similarly threaded on every guide eye with another set of inelastic body yarns 14 from a third warp beam (also not shown).

Preferably, all of the body yarns 12, 14, are multifilament synthetic yarns, e.g., polyester, but may be of differing denier and filament makeup. For example, in the preferred embodiment of the present fabric depicted in FIG. 2, the body yarns 12 of the middle guide bar II are a 40 denier, 13 filament dull polyester yarn of a tri-lobal cross-sectional shape, while the body yarns 14 of the top guide bar III are a 45 denier, 13 filament dull polyester yarn of an essentially round cross-sectional shape. Of course, those persons skilled in the art will recognize that various other types of body yarns may also be employed as necessary or desirable according to the fabric weight, feel, and other characteristics sought to be achieved.

Similarly, various types or forms of elastic yarns may be utilized as the elastic yarns of bottom bar I. By way of example, the elastic yarns 10 in the preferred embodiment of FIG. 2 are monofilament zinc-free LYCRA brand yarns of a 140 denier and a fifty percent (50%) stretchability.

Figure 2:
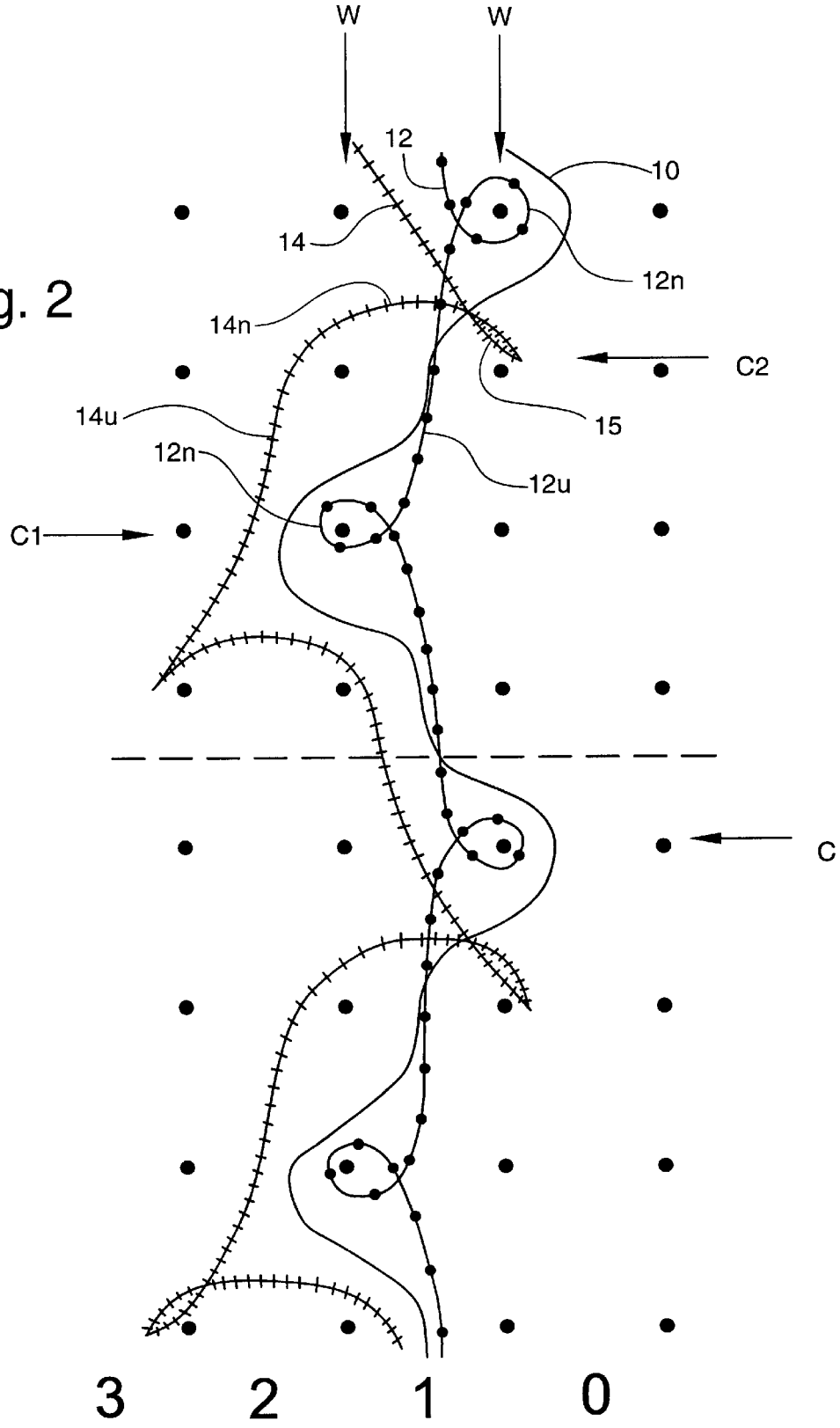
FIG. 2 is a similar point diagram showing the stitch patterns for, and the interconnecting relationship between, the body and elastic yarns carried out by a warp knitting machine in knitting one preferred embodiment of a warp-knitted fabric according to the present invention.

With more particular reference now to the accompanying drawing of FIG. 2, one particular preferred embodiment of the present warp knitted fabric of a three-bar construction knitted according to the present invention on a three-bar warp knitting machine, is illustrated in a traditional dot or point diagram format wherein the repeating stitch patterns of the body and elastic yarns as carried out by the respective lateral traversing movements of the guide bars of the knitting machine are diagramatically represented in the formation of several successive fabric courses C across several successive fabric wales W, with the individual points 15 representing the needles of the needle bar of the knitting machine in the formation of such courses and wales.

According to this embodiment, the bottom guide bar I of the machine manipulates the elastic yarns 10 to traverse laterally back and forth relative to the needles 15 of the needle bar of the machine to stitch the elastic yarns 10 in a repeating 1-1, 2-2, 1-1, 0-0 inlay pattern as the elastic yarns 10 are fed progressively from their respective warp beam. Simultaneously, the middle guide bar II of the knitting machine manipulates the body yarns 12 as they are fed from their respective warp beam to traverse relative to the needles 15 to stitch the body yarns 12 in a repeating 1-1, 1-2, 1-1, 1-0 stitch pattern and, at the same time, the top guide bar III of the machine manipulates the body yarns 14 as they are fed from their respective warp beam to traverse relative to the needles 15 to stitch the body yarns 14 in a repeating 1-3, 2-2, 2-0, 1-1 double needle overlap stitch pattern.

As will thus be understood, the elastic and body yarns 10, 12, 14 are interknitted with one another in the described stitch constructions with each body yarn 12 being formed in respective series of needle loops 12*n* appearing in alternating fabric courses C1 and in connecting underlaps 12*u* extending between the successive needle loops 12*n* across the intervening fabric courses C2, while each elastic yarn 10 is inlayed within the needle loops 12*n* in the alternating courses C1 and each body yarn 14 is knitted in the aforementioned pattern of an overlap 14*n* across two needles in each intervening course C2 with an underlap 14*u* extending between the overlaps 14*n*.

In this manner, the respective stitch patterns executed by the elastic and body yarns 10,12, 14 impart to the fabric a much higher than conventional degree of uniform stretchability in both widthwise (i.e., coursewise) and lengthwise (i.e., walewise) directions. In comparison specifically with the conventional fabric of FIG. 1, the present fabric at a given weight has a widthwise stretchability approximately fifteen percent (15%) greater than the fabric of FIG. 1 and a lengthwise stretchability approximately thirty percent (30%) less than the fabric off FIG. 1. Likewise, as compared to the fabric of FIG. 1, the stitch patterns of the constituent yarns in the present fabric cause the fabric to exhibit a much improved resistance to snagging or picking on both sides of the fabric. Furthermore, as a result of the use of the dull finish polyester body yarns 12, 14 in conjunction with the yarn stitch patterns in the present fabric, each surface of the fabric has a matte finish as compared to the conventional fabric of FIG. 1 which has a shiny satin appearance on one face and a non-satin appearance on the opposite face. As a result, the fabric of the present invention is uniquely and more advantageously suited for use in any swimwear or other activewear applications for which the conventional fabric of FIG. 1 is typically used, without to be recognized disadvantages or shortcomings of the conventional fabric.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A warp-knitted textile fabric adapted for use in activewear apparel and characterized by a matte surface effect, resistance to snagging, and stretchability which is relatively uniform in each of widthwise and lengthwise directions, the fabric having a three-bar warp knitted structure comprised of three sets of warp yarns interknitted in a Raschel-type stitch pattern forming stitches in lengthwise wales and widthwise courses, wherein one of the sets of warp yarns is knitted in a double needle overlap pattern forming a plurality of overlaps of the one yarn with each overlap spanning two adjacent wales.

2. A warp-knitted textile fabric according to claim 1, wherein the three sets of warp yarns comprise first and second sets of body yarns and a third set of elastic yarns.

3. A warp-knitted textile fabric according to claim 2, wherein one of the sets of body yarns is knitted in the double needle overlap pattern.

4. A warp-knitted textile fabric according to claim 3, wherein the set of elastic yarns is knitted in an inlay pattern.

5. A warp-knitted textile fabric according to claim 3, wherein the other set of body yarns is knitted in a plain stitch pattern.

6. A warp-knitted textile fabric according to claim 3, wherein the one set of body yarns is knitted in a repeating 1-3, 2-2, 2-0, 1-1 double needle overlap pattern.

7. A warp-knitted textile fabric according to claim 6, wherein the other set of body yarns is knitted in a repeating 1-1, 1-2, 1-1, 1-0 stitch pattern, and the set of the elastic yarns is knitted in a 1-1, 2-2, 1-1, 0-0 inlay pattern.

* * * * *